US005981045A

United States Patent [19]

Kuwabara et al.

[11] Patent Number: 5,981,045

[45] Date of Patent: Nov. 9, 1999

[54] INK TRANSFER MEDIUM AND IMAGE FORMATION USING THE SAME

[75] Inventors: Nobuyuki Kuwabara, Kawasaki; Yuji Akiyama, Yokohama; Miyuki Fujita, Tokyo, all of Japan

[73] Assignee: Canon Kabushiki Kaisha, Tokyo, Japan

[21] Appl. No.: 08/926,457

[22] Filed: Sep. 10, 1997

Related U.S. Application Data

[63] Continuation of application No. 08/314,300, Sep. 30, 1994, abandoned.

[30] Foreign Application Priority Data

Oct. 1, 1993 [JP] Japan ..... 5-246746
Aug. 9, 1994 [JP] Japan ..... 6-187569

[51] Int. Cl.[6] ..... B41M 5/00

[52] U.S. Cl. ..... 428/212; 428/195

[58] Field of Search ..... 428/195, 480, 428/484, 488.1, 488.4, 500, 520, 212

[56] References Cited

U.S. PATENT DOCUMENTS 5,006,502 4/1991 Fujimura et al. ..... 428/195

FOREIGN PATENT DOCUMENTS 53-065483 6/1978 Japan .
60-076343 4/1985 Japan .
61-055277 3/1986 Japan .
62-053492 3/1987 Japan .

*Primary Examiner*—Pamela R. Schwartz
*Attorney, Agent, or Firm*—Fitzpatrick, Cella, Harper & Scinto

[57] ABSTRACT

A transfer medium includes a transfer portion having a transfer characteristic capable of separating only a region imparted with ink.

6 Claims, 5 Drawing Sheets

INK TRANSFER MEDIUM AND IMAGE FORMATION USING THE SAME

This application is a continuation of application Ser. No. 08/314,300 filed Sep. 30, 1994, now abandoned.

BACKGROUND OF THE INVENTION

1. Field of the Invention

The present invention relates to a transfer medium applicable for a method of forming an image by transfer, and particularly to a transfer medium effective for liquid ink and a method of forming an image by transfer of ink using the transfer medium. The present invention further concerns a method of forming an image which enables the printing by liquid ink on various printing media, for example, a simple textile printing using a cloth as an image support.

2. Background Art

Printing techniques have been variously proposed and put in practical use. In particular, as information processing techniques have been significantly developed in recent years, printing methods using liquid ink have been widely used as output units of computers, facsimiles and word processors. Of these printing methods, an ink Jet printing method is of a type with non-impact, in which there is little generated noise upon printing. It is further advantageous in enabling high speed printing, and in carrying out printing on a plain paper sheet without any specific fixing process, and therefore, it has been widely used.

The ink jet printing method having the above advantages has been applied for various printing media as well as a plain paper sheet. In particular, the application for textile printing on cloths has been remarked. However, a textile printing apparatus is on the industrial scale, and it is difficult for a user to easily and freely perform the precise printing using the above apparatus.

Such an ink jet type textile printing has been proposed, for example in Unexamined Japanese Patent Publication No. SHO 61-55277. It discloses a cloth used for ink jet printing which contains a compound having no dyeing affinity substantially against a dye to be printed to the cloth in an amount of 0.1 to 50 wt %, and an ink jet printing method using the cloth, thereby preventing bleeding of the ink jet printing. However, this method does not examine the initial feeding ability of the cloth in the general ink jet printer, and therefore, it is practically limited to the industrial textile printing application.

A technique for solving the above problem has been disclosed by the applicant of the present invention in Unexamined Japanese Patent Publication No. SHO 62-53492. In this technique, a broad cloth of 100% cotton is dipped in a solution containing the component of an ink receiving layer and is slightly squeezed, and is then put on a commercial reporting paper sheet, so that the broad cloth of cotton is easily mounted on a printer, thus ensuring the feeding ability of the cloth while preventing the bleeding and blurring of an image. In this method, the cloth after printing is removed from the printer, after which the fixing is performed and the ink receiving layer solution is removed with a neutral detergent, thus forming a printed article by an ink jet printer. With this method, the ink jet textile printing on a non-industrial scale becomes possible using only the solution containing the component of the ink receiving layer, cloth, ink jet printer, and drier; or a plain paper sheet, steam iron and commercial detergent. As for the liquid and the solution containing the component of the ink receiving layer suitable for the cloth, these are not widely commercially available, but can be obtained by ink jet printer manufacturers or the like.

In the above method, since the ink jet printer is of a type wherein a printing medium is manually mounted on a cylindrical platen as a main feeding means, the cloth overlapped on a paper sheet is easily mounted. However, in the recent ink jet printer, a printing medium is mainly automatically mounted to a feeding means; accordingly the mounting described in the above method is not suitable for the feeding means of this automatic mounting type ink jet printer. Moreover, a cloth tends to cause wrinkling, and thereby generates irregularities on the surface to be printed, resulting in the disturbance in a printing image, and the breakage of a printing head. In the above method, therefore, it is very difficult to handle a cloth.

To avoid the difficulty in handling a cloth, there may be considered a method using transfer type textile printing.

This method has been already proposed using thermal transfer printing. It includes the steps of preparing an intermediate transfer medium in which an ink receiving layer separable in a film shape by heating is formed on a base material such as a paper sheet; carrying out printing on the intermediate transfer medium, overlapping the ink receiving layer side of the intermediate transfer medium on a cloth, ironing the laminated body from the base material side for separating the whole ink receiving layer from the supporting body together with a printing image, thereby bonding it to the cloth. In this case, however, the portion except for the printing image, that is, the portion except for a region stuck with ink is transferred and bonded on the cloth, so that the film-like ink receiving layer is present over the whole cloth. This causes a problem that the surface of the cloth is quite different from the original one in quality and feeling.

On the other hand, a method using ink jet printing has been disclosed, for example in Unexamined Japanese Patent Publication Nos. SHO 53-65483 and SHO 60-76343. In the former, ink jet printing is performed on a transfer sheet constituted of a sheet base coated with transfer varnish, to form an image, and a cloth to be printed is overlapped on the transfer sheet and pressurized at a specified pressure, thus transferring an image on the cloth. In this method, the transfer varnish in a region formed with no image tends to be transferred on the cloth together with the image; or it is difficult for a user to easily remove only the transfer varnish without disturbance of the image by the soaping performed after the transfer.

In the latter, that is, in Unexamined Japanese Patent Publication No. SHO 60-76343, there has been proposed a method of imparting ink containing dye on a smooth surface endless support having no affinity with dye and no permeability for dye, removing solvent, and continuously transferring the dye on a cloth. In this method, only the image portion can be transferred on the cloth; however, the special ink jet printing apparatus has an endless support, and accordingly it is also difficult for a user to easily perform the printing on a cloth using a commercially available ink jet printer.

Thus, there are required a new transfer medium and a new method of forming an image using the transfer medium, which is capable of using the commercially available ink jet printer, being easy in handling, and keeps the quality of the cloth after printing.

SUMMARY OF THE INVENTION

An object of the present invention is to provide a means enabling to print by ink on various printing media in a non-industrial field, to provide a simple textile printing particularly used for a cloth, and to provide a method of simply obtaining a clear printing image by ink jet textile printing without any difficulty in feeding a cloth on a printing apparatus.

Another object of the present invention is to provide a simple textile printing and apparatus thereof using an ink jet technique, and further a medium used in the above method; and particularly to provide a method easy in handling and without harming the quality of a cloth after printing.

A further object of the present invention is to freely print an image on various materials as well as a cloth.

A still further object of the present invention is to provide an automatic system easily obtained by assembling a series of apparatuses and methods having the above features.

An additional object of the present invention is to apply the precise color expression obtained by a color ink printing method using liquid ink not only to an industrial field but also to a domestic interest field.

To achieved the above objects, according to a first aspect of the present invention, there is provided a transfer medium including a transfer portion having a transfer characteristic capable of separating only a region imparted with ink. The transfer portion may include, at least on the surface side, a liquid reactive resin layer enabling the partial transfer by imparting of a liquid ink as the above ink. The liquid reactive resin layer may exhibit an adhesive property and permeability by imparting of the above liquid ink. The liquid reactive resin layer may be made of a resin having no adhesive property, and which has a separation layer exhibiting an adhesive property by application of an external force, on the inner surface side from the liquid reactive resin layer. The liquid reactive resin layer may be made of a water-soluble resin. In the transfer medium, on a base material, the liquid reactive resin layer as the outermost layer may be formed by way of a bonding layer having a bonding force with the base material reduced by application of an external force.

To achieve the above object, according to a second aspect of the present invention, there is provided a method of forming an image by ink transfer, including the steps of: imparting a liquid ink corresponding to the mirror image to a final ink image on the above transfer medium; contacting the liquid reactive resin layer side of the transfer medium with an image support to which the image should be transferred; and heating and/or pressurizing the laminated body from the transfer medium, thereby transferring an ink image on the image support. The imparting of the liquid ink may be performed by ink droplet by ink jet printing. The image support may be a cloth.

The method of forming an image is very effective for a cloth as a printing medium. However, the present invention may be extensively applied to other printing media with the surfaces thereof not obstructing the sticking of adhesive materials, such as paper sheets, surfaces of metal plates and wood.

DETAILED DESCRIPTION OF THE PREFERRED EMBODIMENTS

Figure 1:
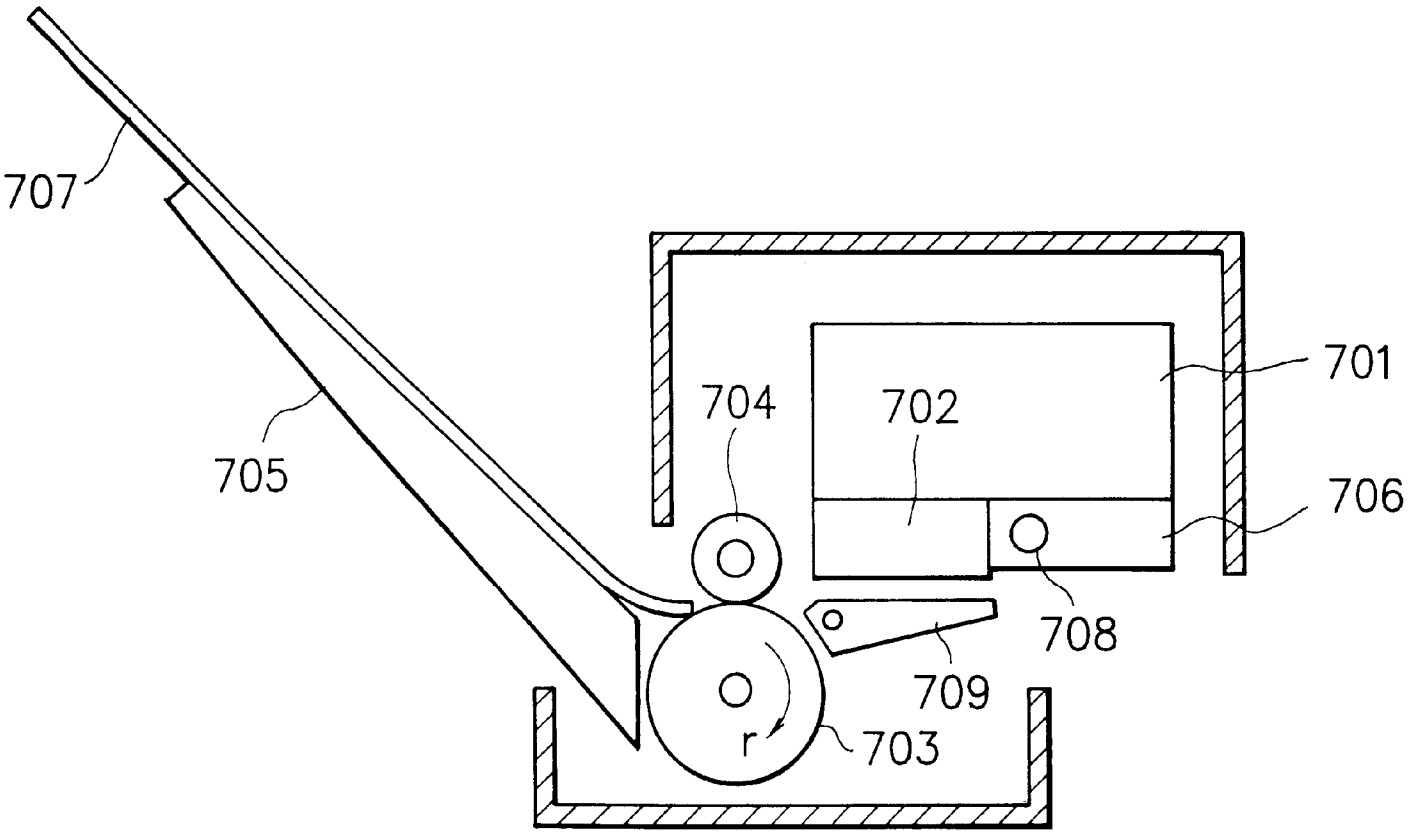
FIG. 1 is a view showing the essential portion of an ink jet printing apparatus used in embodiments of the present invention.

In the present invention, by use of the transfer medium including a transfer portion having a transfer characteristic capable of separating only a region imparted with ink, the transfer from an unnecessary portion of a transfer medium can be suppressed, thereby solving the conventional problem in spoiling the material of an image support to which an image is transferred. Here, the expression "only a region imparted with ink" is desirable to include the state where the region imparted with ink is all transferred; however, it may include the state where the portion of the region imparted with ink, such as a portion of a contour and a portion of the transfer portion in the thickness direction is not transferred; and may include the state where a peripheral portion slightly outside the region imparted with ink is transferred. In each case, the present invention certainly solves the conventional problem in that the whole transfer portion is transferred. As the typical example of the present invention, the transfer portion includes a liquid reactive resin layer enabling the partial transfer by imparting liquid ink. The liquid reactive resin layer includes types being reactive with dye or, solvent in ink, and with the combination thereof.

The transfer medium of the present invention has a liquid reactive resin layer in which a transfer portion exhibits an adhesive property and permeability against an image support. The liquid reactive resin layer is not necessarily constituted of one kind of layer, and may be constituted of two kinds of layers each having an adhesive property and permeability. In this case, a layer having permeability and a layer having the adhesive property are arranged from the side of an image support in this order, which is effective to shift a transfer portion. Moreover, in this case, since the layer having an adhesive property, that is, the separation layer is not directly contacted with the image support, the bonding force of the separation layer is difficult to be applied to the image support, and therefore, it is important to add an external force for accelerating the bonding force. As the external force, the force by heating and pressurization is effective. Accordingly, the separation layer is preferably constituted of a material exhibiting an adhesive property by imparting ink and increasing the bonding force by heating and pressurization. The materials having the characteristic of increasing the bonding force by heating and pressurization have been variously known. On the other hand, a layer having permeability which is directly contacted with an image support has a characteristic of no adhesive property, so that a region not imparted with ink, that is, a region where the transfer is unnecessary is not transferred.

The shift of an image to an image support becomes possible by the effect of these adhesive property and permeability. In this case, the addition of an external force is effective to certainly transfer an image. Here, the external force may include pressure, heat, steam, or the combined force thereof.

The liquid reactive resin layer, which is provided with a separation layer, as needed, is effective by itself; however, to achieve the easy handling, these layers may be provided on a base material. In this case, the above layers must be forcibly bonded on the base material before the imparting of ink, so that a bonding layer may be interposed in between. The bonding layer, however, must not obstruct the transfer of an image. To satisfy the characteristic, the above external force may be used. For example, it is desirable that when the external force, for example, heat, is applied, the bonding layer is melted and is reduced in viscosity, to be thus lowered in the bonding force. The bonding layer is not essential in the present invention; however, it is effective for certainly performing the shift of an image even by application of less external force.

In the present invention, the partial transfer can be achieved by the imparting of ink. Solvent of a liquid ink is not particularly limited, but it generally comprises water, and thereby a liquid reactive resin layer preferably comprises a water soluble resin.

Prior to the transfer of an image, the mirror image to the original image must be printed on a transfer medium, and for this purpose, there may be used an output unit for forming an image by dot matrix, particularly, an ink jet printing apparatus for achieving the image formation by ejecting a liquid ink.

The present invention, which provides a new technique of applying precise color expression by a simple transfer textile printing using an ink jet technique to a domestic interest field, will be described in detail with reference to the following embodiments.

Figure 2:
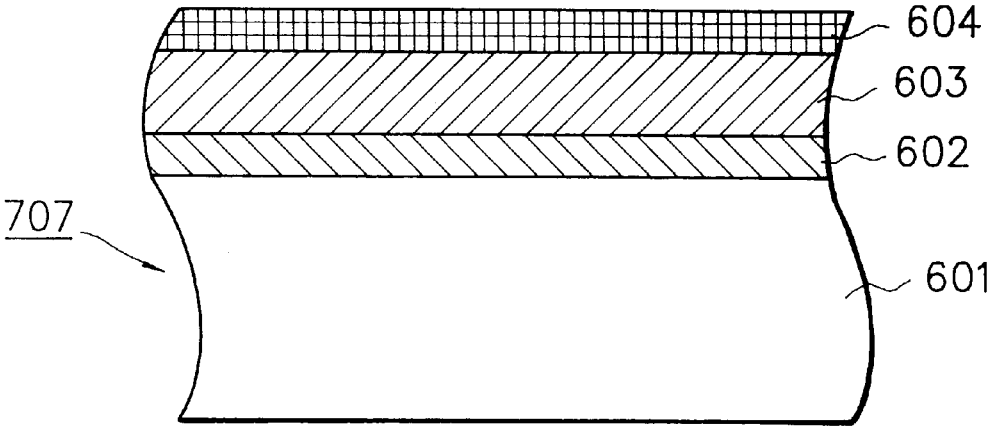
FIG. 2 is a view showing one example of a transfer medium used in the embodiments of the present invention.
Figure 3:
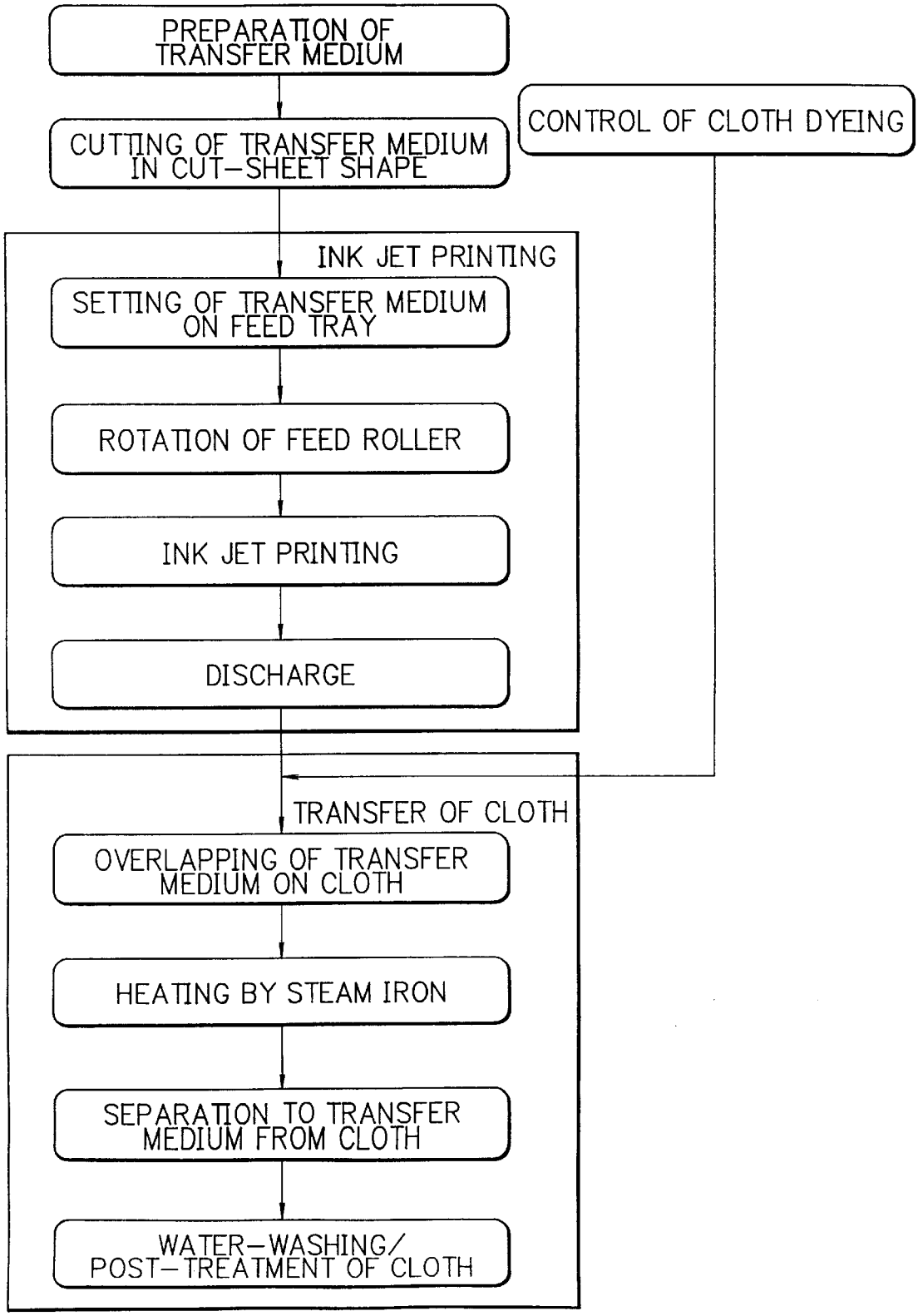
FIG. 3 is a block diagram showing one example of a method of performing a textile printing to a cloth in the embodiments of the present invention.

First, there will be an example in which ink is imparted to a transfer medium using ink jet printing. The present invention, however, can be achieved by other methods capable of imparting ink in a non-contact manner. FIG. 1 shows one example of an ink jet printing apparatus applicable for the present invention; FIG. 2 is one embodiment of a transfer medium of the present invention; and FIG. 3 is a block diagram showing one embodiment in which transfer type textile printing is performed to a cloth using the ink jet printing apparatus and transfer medium.

FIG. 1 shows the main construction of a feeding means of a transfer medium and an ink jet printing means. The operation for imparting an ink to a transfer medium according to the present invention will be described with reference to FIG. 1. Hereinafter, the formation of a mirror image on a transfer medium by the imparting of ink is simply referred to as "printing".

First, the surface of a base material of polyethylene terephthalate (hereinafter, referred to as "PET") is pretreated for receiving ink droplets. The base material is then cut, thus forming a cut-sheet like transfer medium 707. The transfer medium 707 is set on the upstream side in the feeding direction from a pair of feeding rollers (feeding drive roller 703 and feeding driven roller 704) as a feeding means in an ink jet printing apparatus. After the preparation of the ink jet printing (recovering of an ink jet head and set-up of image data), the printing on the transfer medium is started. The feeding drive roller 703 and feeding driven roller 704 are first rotated, and the cut-sheet shaped transfer medium 707, the leading edge of which abuts on the feeding drive roller 703, is drawn in a press-contact portion of the feeding rollers. The transfer medium 707 is thus automatically mounted onto the feeding means. The transfer medium 707 has a sufficient feeding ability because of the stiffness of PET, and it is stably subjected to the feeding and the ink jet printing in the same manner as in a plain paper sheet frequently used. Next, an ink jet printing portion provided in the feeding path is operated in synchronization with the feeding of the transfer medium, thereby performing the printing on the transfer medium on the basis of the image data. The transfer medium, which is discharged from the ink jet printing apparatus after printing holds an ink on the surface. The surface bearing the image (opposed to the base material) of the transfer medium is overlapped on an objective cloth, and heated by means of a steam iron from the side of the base material, so that the ink held on the transfer medium is shifted (transferred) on the cloth. After the removal of the transfer medium, the cloth is naturally dried, being fixed by heating as needed, and is washed. It is further naturally dried, thus obtaining the cloth to which the image is transferred.

Ink Jet Printing Apparatus

The construction of each essential portion of the ink jet printing apparatus shown in FIG. 1 will be described below. In this figure, a carriage 706 mounts an integral printing head cartridge 702 integrally including four ink tanks 701 respectively containing inks having four kinds of colors, black, cyan, magenta and yellow and four printing heads 174 (see FIG. 4) for ejecting four color inks. In this embodiment, to stably perform the automatic mounting of a transfer medium to a pair of the feeding rollers, a feed tray 705 is provided. Only by inserting the transfer medium 707 along the feed tray 705, the leading edge of the transfer medium correctly abuts on a feeding drive roller 703. In such a state, by rotating the feeding drive roller 703, the leading edge of the transfer medium 707 is correctly led to the press contact portion of the feeding rollers, and is automatically mounted in the feeding rollers without any generation of meandering and wrinkling. In the case where the feed tray is not prepared, the leading edge of the transfer medium may be touched to the press contact portion of the feeding rollers, and the feeding drive roller may be rotated. Moreover, the known paper feed registration adjustment mechanism may be applied. The feeding drive roller 703 is rotated in the direction of the arrow <r> while suppressing the transfer medium 707 automatically mounted in association with the feeding driven roller 704, thereby sequentially feeding the transfer medium 707. When no printing, or when the printing heads are recovered, the carriage 706 stands by at the home position (not shown).

With this construction, the actual printing is performed as follows. First, the carriage 706 at the position (home position) shown in the figure before printing is moved along a carriage guide shaft 708 according to a printing start command, and discharges four color inks from nozzles on the printing heads 174 with timing on the basis of a read-out signal of a linear encoder, so that the printing is performed by a printing width <d> on the printing surface of the transfer medium. By this scanning for printing, the black, cyan, magenta, and yellow inks are ejected in this order, thus forming a mirror image. After the printing is completed up to the end portion of the transfer medium, the carriage is returned to the original home position, and the printing for the next line is performed again. Until the first printing is completed and the second printing is started, the transfer medium is fed by the printing width <d> by the rotation of the ejected feeding drive roller 703. By repeating the printing and feeding of the transfer medium by the printing width <d> for each one scanning of the carriage, the whole printing on the transfer medium is completed. At the time when the printing is all completed the transfer medium is discharged by the feeding means, and simultaneously the platen 709 which forms the flat printing plane at the printing operation is tilted in the discharge direction for assisting the discharge of the rear end portion of the transfer medium. A spur roller may be provided on the downstream side from the printing portion to assist the discharge of the transfer medium and to stably suppress the transfer medium at the printing portion.

Moreover, in this ink jet printing apparatus, the ejected amount of ink can be adjusted/selected according to the kind of a transfer medium used. In the case of printing on a plain paper sheet, the maximum ejected amount of ink is restricted in terms of the lowering of resolution, bleeding between colors, strike through, and increase in the fixing time. In general, for a water-based ink, the maximum ejected amount of ink is designed to be in the range of 16 to 28 nl/mm$^2$. However, in the case of printing on a special medium just as in the present invention, the ejected amount of ink may be increased according to the characteristic of a portion imparted with ink. In this embodiment, the ejected amount of ink can be increased as needed, by performing a high density printing with a printing speed lower than that corresponding to the printing frequency, for example, performing a double density printing at the printing speed reduced into a half, performing the overlapping printing by plural times of scanning in the same printing region; controlling the ink jet head drive for increasing the discharge amount of ink, for example, increasing the heat reserving temperature for the thermal ink jet head or performing multi-pulse drive.

Figure 4:
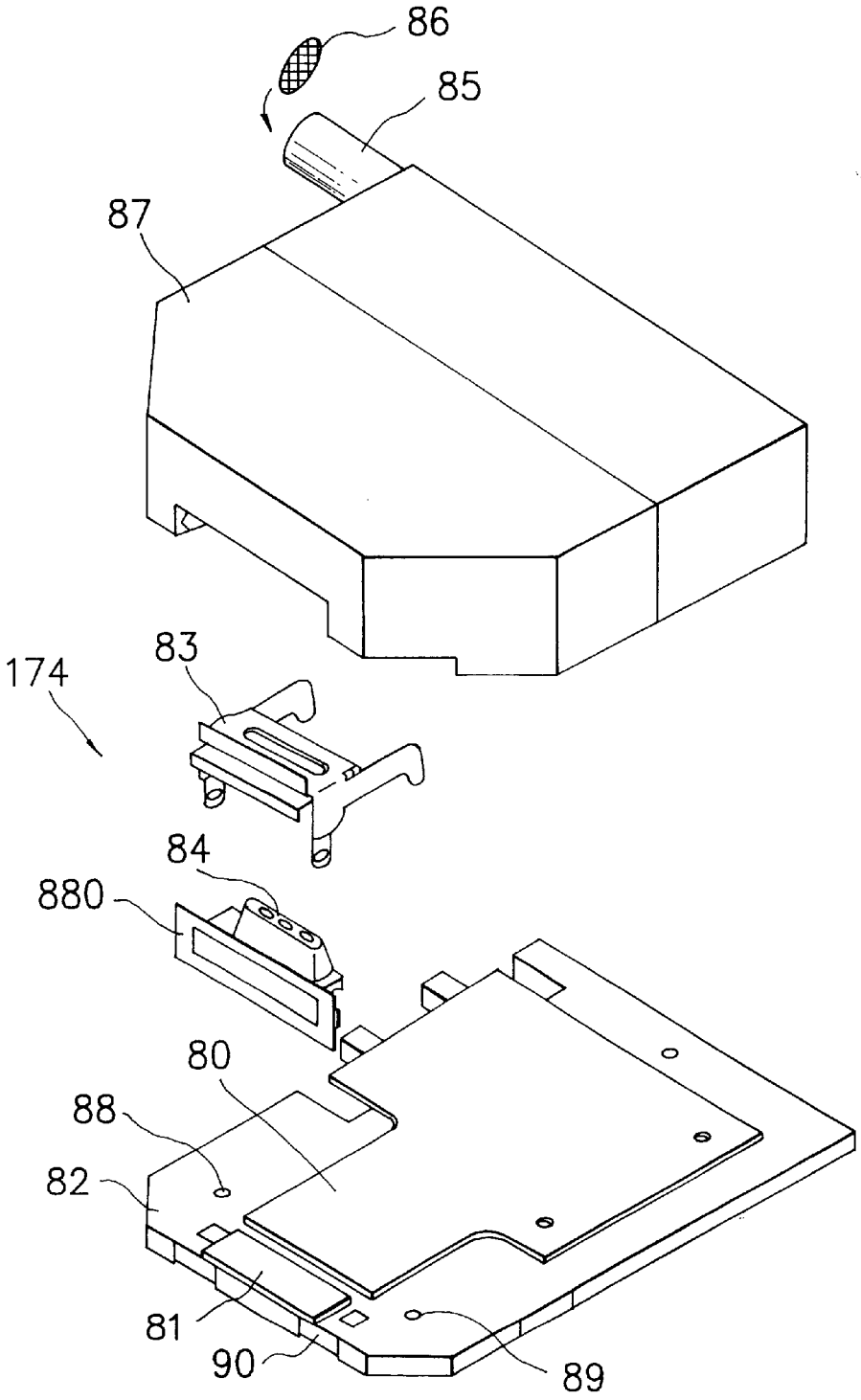
FIG. 4 is a view showing the construction of an ink jet printing head applicable for the present invention.

FIG. 4 is a view for explaining the construction of the printing head 174 for ejecting ink. One end of a wiring board 80 is connected to the wiring portion of a heater board 81, and the other end of the wiring board 80 is provided with a plurality of pads corresponding to electric-heat energy converting bodies for receiving electric signals from the main body of the apparatus. Accordingly, the signal from the main body of the apparatus is supplied to the electric-heat energy converting bodies. A metal made support 82 for supporting the rear surface of the wiring board 80 becomes the bottom plate of the ink jet unit. A pressing spring 83 includes a portion bent in an approximately U-shape in section for linearly and elastically applying a pressure on a region near ink discharge ports of a grooved top plate (having a groove forming a wall surface of each nozzle for ejecting ink); a claw hung using an escape hole provided on a base plate; and a pair of rear legs for receiving a force applied to a spring by a base plate. By this spring force, the mounting of the wiring board 80 press-contacts the grooved top plate 84. The wiring board 80 is stuck on the support by adhesive.

A filter 86 is provided at the rear portion of an ink supply tube 85. An ink supply member 87 is formed by molding, and the grooved top plate 84, an orifice plate portion 880 and a flow path led to each ink supply port are integrally formed. The ink supply member 87 is simply fixed on a support 82 by passing two pins (not shown) on the rear surface side of the ink supply member 87 through two holes 88, and thermally fusing the two pins to the support 82. In the case, a gap between the orifice plate portion 880 and the ink supply member 87 is sealed, and the gap between the orifice plate portion and the front end portion of the supporting substrate 82 is perfectly sealed.

Figure 5:
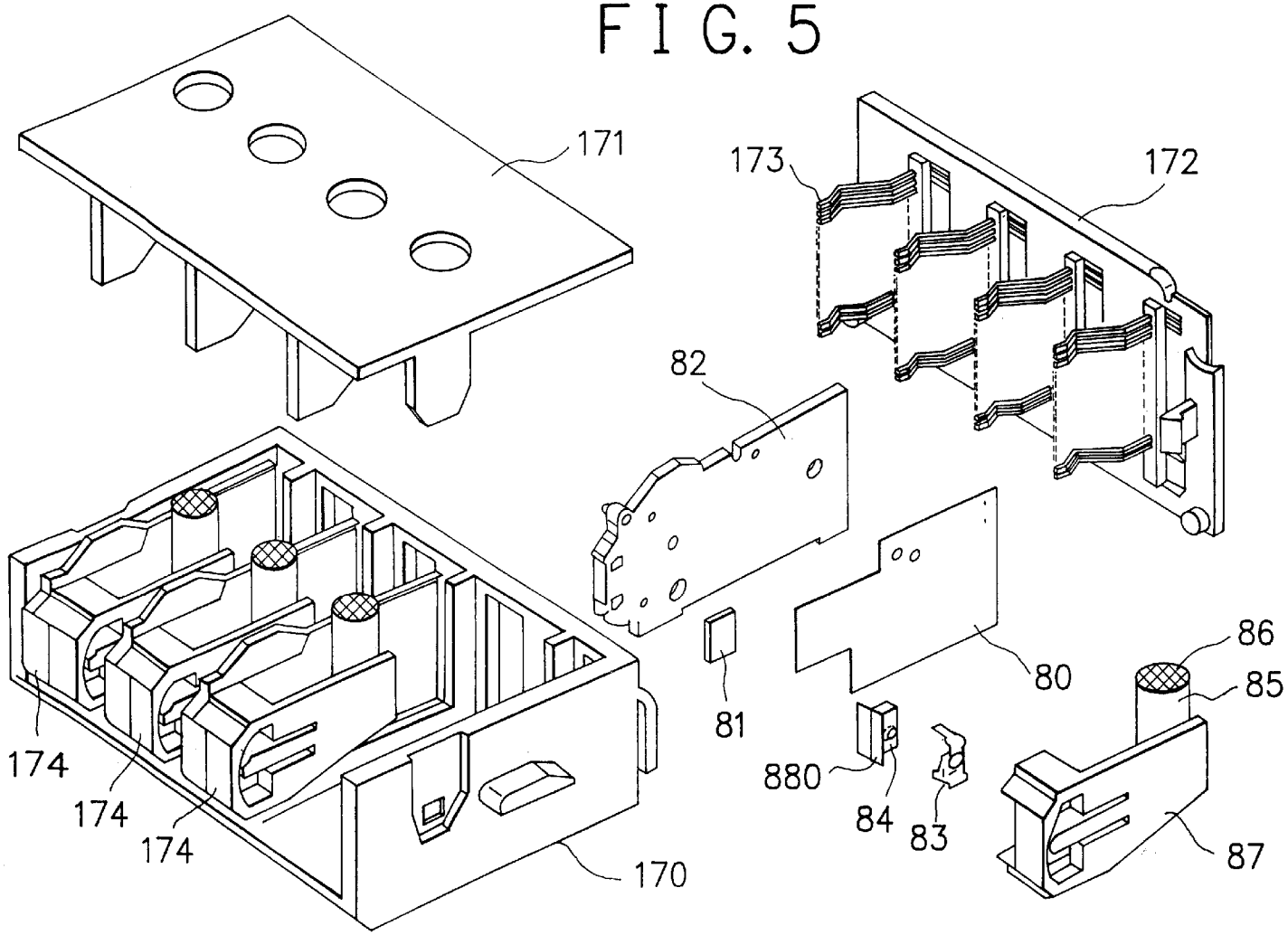
FIG. 5 is a view showing the construction of a color ink jet printing head applicable for the present invention.

FIG. 5 shows the structure of a four head-integral ink jet cartridge 702 in which the above four heads 174 for ejecting inks having four colors of black, cyan, magenta and yellow are integrally provided in a frame 170. The four printing heads are fixed in the frame 170 at specified intervals and in the state that the registration in the direction of a nozzle row is adjusted. In this embodiment the accuracy of the mutual ejected positions of color inks is enhanced by adjustment by use of the mechanical reference planes of the heads; however, it may be adjusted by temporarily mounting the printing heads on the frame and measuring the actual ejected positions thereby directly adjusting the mutual ejected positions of color inks on the basis of the data. Reference numeral 171 designates a cover of the frame; 173 is a connector for supplying an electric signal from the main body of the printing apparatus to each of the pads provided on the wiring board of the four printing heads. The integral assembly of the four heads is desirable in handing and improves the accuracy of the mutual ejected positions of color inks, and further it has an effect to reduce number of the signal lines connected to the main body of the printing apparatus. For example, the signal lines for the four heads, such as GND lines are made in common on the connector substrate 172, thus reducing the number of the lines. The printing signal lines can be made in common by providing an integral circuit board for performing time division drive for each head. The reduction in the number of the electric signal lines is effective for a color machine or multi-nozzle high speed machine having a large number of signal lines.

Transfer Medium

FIG. 2 is a typical sectional view showing the construction of one example of the transfer medium 707 used in the above description.

The transfer medium is mounted on a feeding means of an ink jet printing apparatus, and is formed with an image. The function necessary for the transfer medium is as follows: namely, the transfer medium must be certainly fed in the printing apparatus and must certainly receive ink droplet for forming an image on the surface; and when the surface (liquid reactive resin layer) of the transfer medium is overlapped on an image support and applied with an external force such as heat from the base material side of the transfer medium, the ink forming the image must be sufficiently transferred from the transfer medium to the image support. Accordingly, in the transfer medium, a thermally melting material which is lowered in viscosity upon heating is provided on the base material as a bonding layer.

The base material 601 is preferably required to be excellent in heat-resistance, and may include known heat-resisting films, for example, films of polyester such as polyethylene terephthalate, polycarbonate, cellulose triacetate, and cellophane; papers such as woodfree paper, semi-woodfree paper, art paper, and cast coated paper; plates such as glass plate.

The bonding layer 602 laminated on the base material is preferably required to comprise a thermally melting material being lowered in viscosity upon heating, preferably a material having a relatively low molecular weight and having a clear melting point. For example, it may include wax materials such as carnauba wax, paraffin wax, sazol wax, microcrystalline wax, and caster wax; and higher fatty acids or metal salts thereof and derivatives of ester, such as stearic acid, palmitic acid, lauric acid, aluminum stearate, lead stearate, barium stearate, zinc stearate, methylhydroxystearate, and glycerol monohydroxystearate. These may be used in the form of being independent or being blended. To reduce the bonding force with the support upon heating for enhancing the separation of a region imparted with ink, the above bonding layer 602 may be provided with a layer including aggregate of particles formed of colloidal silica, a material having a relatively high crystallinity or emulsion. Moreover, the bonding layer 602 may be added with inorganic salt or fine particles as needed for adjusting the physical properties such as melting point and melting viscosity. The bonding layer is not necessarily perfectly separated from the base material at the time of the transfer of an image to the image support, and may stay on the base material or cut in the interior thereof.

The important physical property of the bonding layer is a melting point or melting viscosity. These are selected according to an external force used for the transfer of an image. When a heat source is set at about 300° C. and a pressure is set at about 10 kgf/cm$^2$ or less, the material of the bonding layer is suitably selected. The melting point is preferably in the range of 30 to 200° C., and the melting viscosity at 150° C. is preferably in the range of 0.002 to 200 Pa.s (rotary viscosity meter). For a material having the above physical property, an external force may be applied by a domestic steam iron.

The separation layer 603 laminated on the bonding layer 602 may include a material having a relatively high molecular weight which is softened upon heating and exhibits an adhesive property. For example, there may be used polyamide resin, polyester resin, epoxy resin having a very high molecular weight, polyurethane resin, polyacrylic resin (such as polymethylmethacrylate, and polyacrylicamide), petroleum resin, rosin derivative, coumarone-indene resin, terpene resin, polyolefin resin (such as polyethylene, plypropylene, polybutene, and ethylene-vinylacetate copolymer), polyvinylether resin, polyethyleneglycol resin, elastomer, natural rubber, stylene-butadiene rubber, and isoprene rubber. These may be used in the form of being independent or blended. The material of the bonding layer is not particularly limited in solubility against water or organic solvent, and may be used in the form of emulsion.

The important physical property of the separation layer is a softening temperature. Since the material of the bonding layer has a relatively high molecular weight and is not clearly in melting, it is specified in terms of softening temperature. The softening temperature of the material is in the range of 50 to 200° C. and is selected in association with the difference between the melting point of the bonding layer and the same. The temperature difference becomes important when an external force is heat. Since heat energy is applied from the base material and is transmitted from the base material by way of the bonding layer, the softening temperature of the separation layer is preferably less than the melting point of the bonding layer. The initial temperature difference between both the layers is preferably within 50° C.

The bonding layer 602 is intended to control the shift of the portion imparted with ink to the image support at the time of the transfer and it may be not particularly provided. Namely, in the case that the adhesive force of the separation layer is strong against the image support, and is weak against the base material side when the external force is applied to the transfer medium, the image can be sufficiently shifted without the bonding layer.

The liquid reactive resin layer 604 is required to hold the imparted ink, and is preferably made of a material soluble in the solvent of ink. Since water is generally used for the solvent of ink used for ink jet printing, a water soluble resin is preferably used. In the case of using a water soluble resin, only the corresponding portion of the water soluble resin is readily dissolved when ink droplet is imparted, to form pores or recesses, thereby holding the ink droplet therein. The water soluble resin may include starch, casein, gelatin, maleic anhydride resin, melamine resin, urea resin, SBR latex, sodium alginate, carboxymethylcellulose, polyvinylalcohol, polyvinylpyrrolidone, hydroxycellulose, and polyethyleneoxide. These may be used in the form being independent or blended. When an ink droplet is stuck on the layer, a printing image is not necessarily fixed thereon; accordingly, various water soluble resins can be used.

When an ink droplet is imparted, the corresponding portion of the water soluble resin is dissolved, and the viscosity is lowered by the dissolution, that is, the change in the state, which gives the adhesive property. The adhesive property at this time is dependent on the solubility of the material and the amount of the imparted ink, which further contributes to the transfer of ink at the time of the transfer. In the case where the adhesive force is large, the liquid reactive resin layer can include the function of the separation layer.

The liquid reactive resin layer can be used, in terms of holding of ink, in the form of the emulsion in which a material insoluble in water is diffused in water. It may include emulsions of styrene-acrylic copolymer, vinylacetate resin, vinylacetate-acrylic copolymer, vinylacetate-veoba co-polymer, vinylacetate-malleate copolymer, vinylacetate-ethylene co-polymer, vinylacetate-ethylene-vinylcloride co-polymer, and epoxy resin. The emulsion is required to remain the hydrophilic group after the formation of each layer, and to easily suppress the bleeding in terms of holding of ink, that is, holding of an image, and thereby it is required to have a relatively high minimum film forming temperature. The minimum film forming temperature is preferably 50° C. or more under the consideration of the temperature at which ink is imparted to the transfer medium. On the other hand, in the case where ink is made of organic solvent, the material soluble in the solvent may be used for the liquid reactive resin layer.

To laminate each layer described above, there may be used the known methods, for example a method of preparing a solution in which materials constituting layers are dissolved in a solvent, and coating the solution using a bar coater, roll coater and applicator; a method of sequentially laminating and drying materials by screen printing; and a method bonding or press-bonding film-like materials for forming layers. The thickness of each layer is not finely controlled so much, and may be set in association with the characteristics described above to be in the range of 0.5 to 50 $\mu$m.

Image Support, Image Transfer Method

A cloth as an image support used in the present invention may not be particularly limited, and may include the ordinary type. However, since dye, pigment and the like as components of an ink are generally anionic, a cloth treated with cationic material (cationic cloth) is desirable for increasing the dyeing affinity of an image after the transfer. The cationic cloth may include natural fibers such as cotton, sheep wool, and silk; and synthetic fibers such as nylon and rayon.

The transfer of an image on a cloth using the transfer medium having the above construction is simply performed by heating using a steam iron. The bonding layer is melted by heating to lower the bonding force between a separation layer and a base material, and the separation layer exhibits the adhesive property at the same time of melting and is separated from the base material together with the ink, and is bonded on the cloth and is permeated within the fiber of the cloth. At this time, at the contact portion between the transfer medium and the cloth, the portion not imparted with ink in the separation layer is not transferred because the water soluble resin layer having no adhesive property against the cloth is interposed at the interface of the contact portion. Even if the portion not imparted with ink in the separation layer is transferred to the cloth, it can be removed by water-washing in the subsequent process because it is present on the cloth together with the water soluble resin layer.

Here, the treatment of a cloth will be simply described. In forming an image cloth on a cloth, a material having a polarity is preferably added to the cloth for improving the dyeing and the fixing of the dye. By the above treatment of the cloth performed during or after printing, the dye having ionicity in ink is aggregated by the ionic bonding, and is increased in its fixing to the cloth fiber. Accordingly, the treatment of a cloth may be performed before or after printing. The material having a polarity may include water soluble cationic polymers such as polyallylamine salt, polyamyl sulfone, and dimethyldiallylanmonium chloride; anionic high polymers such as vinylacetate polymer, and modified synthetic rubber. The above material is dissolved or diffused in a solvent such as water or alcohol, or made in emulsion, which may be laminated and permeated in the cloth by coating or spraying. In particular, in the post-treatment, to avoid the bleeding and flow-out of dye before aggregation, it is effective to increase the viscosity of the solution or to use the nonaqueous solvent. The treatment solution can be removed by washing, and does not harm the quality of the cloth.

To enhance the fixing of the image against washing, chemical color fixing, heat-treatment by steam iron and steam treatment by a steamer are effective.

EXAMPLE 1

A 10% emulsion of oxidized polyethylene having a melting point of 130° C. was coated on a PET film 601 having a thickness of 100 μm by a roll coater and then dried at 100° C., thus forming a bonding layer 602 having a thickness of 10 μm. Next, a 30% emulsion of ethylene-vinylacetate co-polymer having a softening temperature of 90° C. was coated on the bonding layer 602 by the roll coater and dried at 60° C., thus forming a separation layer having a thickness of 20 μm. The separation layer 603 exhibits an adhesive property upon heating. A 10% water solution of polyvinyl alcohol was coated on the separation layer 603 and dried at 50° C. by hot air, to form a liquid reactive resin layer 604 having a thickness of 10 μm, thus obtaining a transfer medium. The large size transfer medium thus obtained was cut by means of a slit cutter, to form a sheet-like transfer medium 707 having a size of A4. The reason why the above coating materials are all made of the aqueous materials is that the materials in ink excluding dye can be washed by water after the image is transferred to a cloth. A mirror image was printed on the transfer medium 707 using the ink jet printing apparatus shown in FIG. 1. After the printing was completed, the transfer medium 707 was discharged from the ink jet printing apparatus, and was naturally dried for 10 min.

The transfer medium 707 was then contacted with a cloth and the image was transferred thereon. A cloth of 100% of cotton as the cloth was subjected to dyeing control using the following treatment solution for further improving the dyeing performance of ink at the time of the ink transfer, thus obtaining the cloth. The above dyeing control is performed depending on the composition of the ink used. In general, an anionic direct dye is frequently used in ink jet printing; accordingly, by applying cationic treatment to the cloth, ion bonding is generated at the time of the transfer, thus readily accelerating the fixing of the dye.

The dyeing control for the cloth was performed by the steps of preparing a treatment solution (A) (100 parts by weight of urea, 30 parts by weight of sodium hydrogencarbonater 10 parts by weight of metanitrobenzene sodium sulfonate, and 860 parts by weight of water) according to the desired cloth and ink jet ink; treating the base cloth using the treatment solution (A) through a close pattern with 100 meshes by a printer of timer type; and drying the base cloth at 100° C. for 2 min. Alternatively, the above dyeing control was performed using a treatment solution (B) which was prepared by agitating a mixture solution (10 parts by weight of CI reactive blue-49, 25 parts by weight of diethylene glycol, and 65 parts by weight of water) for 2 hr, followed by filtering.

Subsequently, the ink imparted surface (printing surface) of the transfer medium 707 after being naturally dried was overlapped on the surface of the cloth on which the image was to be formed. The transfer medium 707 was placed on the flat surfaces with the base material 601 directed upward, and was heated and pressurized over the surface from the base material 601 side using a domestic steam iron adjusted on the contact surface at about 120° C. After that, the transfer medium 707 was left as it was until the temperature of the base material 601 was returned to room temperature. The transfer medium 707 was then separated from the cloth. The original image data by the ink jet printing apparatus emerged clearly on the cloth.

After completion of the transfer, the following post-treatment for dye fixing may be effectively performed to improve the fixing of the image against water washing. The post-treatment is intended to improve the fixing of the dye against the fiber using the ionicity of the dye as the color material. The post-treatment includes a method of exposing the cloth in steam at a temperature over 100° C. for accelerating ion bonding between the dye and fiber in the presence of water content thereby enhancing the fixing of the dye; imparting a material having a polarity, and aggregating the dye molecules by ion bonding between the dye and ions thereby enhancing the fixing of the dye; or covering the fiber of the dyeing portion by a color fixing agent used for the general textile printing thereby enhancing the fixing of the dye.

EXAMPLE 2

A film of triacetylcellulose having a thickness of 50 μm was used as a base material. On this base material, paraffin wax having a melting point of 60° C. was coated by hot melt, thus forming a bonding layer having a thickness of 5 μm. On the bonding layer, a water soluble liquid reactive resin layer made of polyvinylpyrrolidone having a thickness of 10 μm was formed, thus forming a transfer medium. The transfer medium was cut in a size of A4. A mirror image was then printed on the transfer medium using the ink jet printing apparatus shown in FIG. 1. After that, the transfer medium thus printed was overlapped on a cloth as in Example 1, which were placed on a flat plate-like member. A roller kept at about 90° C. was then rotated on the above film at a speed of 5 mm/sec. After scanning over the surface of the base material, the transfer medium was separated from the cloth, as a result of which a clear printing image was obtained on the cloth.

In this example, there is no separation layer described in Example 1; however, the layer of polyvinylpyrrolidone is water soluble by itself and thereby keeps the liquid ink from significantly generating the bleeding in the plane direction and contains a slight amount of water and exhibits a suitable adhesive property and flowability, which are continued for some time. On the other hand, paraffin wax has a crystallinity, and is melted by heating and loses the bonding force between the triacetylcellulose film as the base material and polyvinylpyrrolidone as the liquid reactive resin layer.

With these properties, the ink held in the transfer medium tends to be shifted to the cloth. Moreover, polyvinylpyrrolidone does not generate the adhesive property and flowability at a region not imparted with ink, so that there is no portion contributing to the transfer of ink except for the image formation portion. Since the wax component is transferred somewhat to the cloth together with the resin containing dye, the cloth exhibits durability against water without any special treatment because of the hydrophobic property of wax.

EXAMPLE 3

A woodfree paper having a thickness of 40 μm was coated with silicone resin to a thickness of 5 μm on one surface, to form a bonding layer. The bonding layer of silicone resin was coated with a solution, obtained by dissolving polyamide resin having a softening temperature of 90° C. in a solvent composed of isopropylalcohol and methylethylketone at a mixture ratio of 7:3, by a wire bar and dried, to form a liquid reactive resin layer having a thickness of 20 μm, thus forming a transfer medium. The transfer medium was cut in a shape of B5. A mirror image was printed by oily ink on the transfer medium by means of the ink jet printing apparatus using a piezoelectric element. The printed transfer medium was then press-contacted with a glass having a spherical surface with the support side facing outward, and a plane heater having the surface temperature of 80° C. was contacted with the transfer medium from the support side for 5 min. After that, the plane heater was removed, and simultaneously the above woodfree paper was separated, as a result of which a clear printing image was stayed on the glass surface. In this case, since there is present silicone resin at the interface between the woodfree paper and polyamide, the woodfree paper as the base material is easily separated. Even in this case, since polyamide exhibits an adhesive property at the portion imparted with ink by itself, only the portion necessary for image formation is transferred.

EXAMPLE 4

A coating solution, in which ethylene-vinylacetate copolymer having a softening temperature of 90° C. was dissolved with toluene, was coated on a PET film having a thickness of 100 μm by a roll coater and dried at 80° C., thus forming a separation layer having a thickness of 10 μm. Next, on the separation layer, an aqueous emulsion of styrene-acrylic copolymer having a lowest film forming temperature of 100° C. was coated by the roll coater, and dried at 70° C., to form a liquid reactive resin layer having a thickness of 6 μm, thus forming a transfer medium. The transfer medium thus obtained was cut in a size of A4 using a slitter cutter. A mirror image was printed on the cut-sheet like transfer medium by the ink jet printing apparatus shown in FIG. 1. The printed transfer medium was overlapped on a cotton cloth without a pattern, which were placed on a base of a domestic steam iron with the cotton cloth being downside. The usual domestic steam iron was contacted with the PET film of the transfer medium and was pressed over the whole surface of the transfer medium for about 1 min. After that, the steam iron was removed, and the laminated body of the cotton cloth and the transfer medium was left as it was until it was cooled. After the temperature was lowered, the PET film was gently separated, as a result which an image formed on the transfer medium was shifted on the cotton cloth, thus enabling the perfect repeatability of the image.

In this case, since ethylene-vinylacetate copolymer constituting the separation layer exhibits the adhesive property upon heating, the bonding force due to the adhesive property is larger for the PET film than that for the cloth, and therefore, the bonding layer can be omitted. The portion not imparted with ink is not shifted to the cloth side because of the non-adhesive property of styrene-acrylic copolymer.

EXAMPLE 5

An emulsion of oxidized polyethylene having a melting point of 60° C. was coated on a PET film having a thickness of 50 μm by a roller coater, and dried at 70° C., thus forming a bonding layer having a thickness of 5 μm. Next, a 10% water solution, in which 0.01% of fluorine base surface active agent was added in a water solution of polyvinyl alcohol, was coated on the bonding layer by the roller coater and dried at 80° C., to form a liquid reactive resin layer having a thickness of 20 μm, thus obtaining a transfer medium. The reason why the surface active agent is added upon coating for forming the liquid reactive resin layer, is to improve the stability of coating ability upon coating the water-insoluble resin layer with the water solution. The transfer medium thus obtained was cut in a size of A4 by a slit cutter.

Then, using the cut-sheet-like transfer medium, a mirror image was printed by the ink jet printing apparatus shown in FIG. 1 in an ejected amount twice the usual amount. After printing, the ink imparted to the liquid reactive resin layer was sufficiently dried by natural drying for 30 min. On the other hand, a cotton cloth not treated was slightly wetted by water using a sprayer, and the surface imparted with the ink of the transfer medium was overlapped on the cotton cloth, which were placed on a base of a domestic steam iron. The steam iron was placed on the laminated body from the PET film side constituting the transfer medium, and slightly pressed over the surface of the transfer medium for about 1 min. After removal of the steam iron, the laminated body was left as it was until the temperature was lowered. The PET film was then separated. The image formed on the transfer medium was thus shifted on the cotton cloth, thus enabling the ceratin image transfer.

Even in this example, upon ironing, the bonding layer is lowered in viscosity by melting, and polyvinyl alcohol slightly exhibits the adhesive property and permeability. However, only the permeability of polyvinyl alcohol makes it difficult to transfer the imparted ink; accordingly, the cloth is slightly imparted with water for improving the transfer performance of the ink. Moreover, the jet ejected amount of the ink is made larger in carrying out printing on the transfer medium, so that even if the dye in the ink permeates within the cloth in the thickness direction, the image on the cloth can keep the concentration of the ink sufficiently.

According to the present invention, a transfer medium has a transfer portion exhibiting the transfer characteristic enabling the separation of only a region imparted with ink. Preferably, it has a liquid reactive resin layer enabling the partial transfer by the imparting of liquid ink, and a separation layer of generating the adhesive property of the transfer portion to the image support by the external force. This makes it possible to easily form a desired image in a suitable condition without harming the quality at the portion except for the image formation portion of the image support. In particular, it is possible to apply simple transfer textile printing to a domestic interest field even if a cloth is used for the image support.

What is claimed is:

1. A transfer medium for printing with ink, said transfer medium comprising:

a base material having a bonding layer on a surface thereof, said bonding layer comprising a heat-melting material;

a separation layer provided on said bonding layer, said separation layer including a resin which is softened to exhibit an adhesive property upon the application of heat; and a surface layer provided on said separation layer, said surface layer comprising a water-soluble resin, wherein said separation layer has a softening temperature which is lower than the melting point of said bonding layer.

2. A transfer medium according to claim 1, wherein said surface layer exhibits an adhesive property when ink is imparted thereto.

3. A transfer medium according to claim 1, wherein the water-soluble resin is selected from the group consisting of starch, casein, gelatin, maleic anhydride resin, melamine resin, urea resin, SBR latex, sodium alginate, carboxymethylcellulose, polyvinyl alcohol, polyvinyl pyrrolidone, hydroxycellulose and polyethylene oxide.

4. A transfer medium according to claim 1, wherein upon the application of heat, said bonding layer reduces its bonding force and said separation layer is separable from said base material.

5. A transfer medium according to claim 1, wherein the separation layer comprises a resin selected from the group consisting of polyamide resin, polyester resin, epoxy resin, polyurethane resin, polyacrylic resin, petroleum resin, rosin derivative, coumarone-indene resin, terpene resin, polyolefin resin, polyvinylether resin, polyethyleneglycol resin, elastomer, styrene-butadiene rubber, and isoprene rubber.

6. A transfer medium according to claim 1, wherein the melting point of said bonding layer ranges from more than 50° C. to 200° C. and said bonding layer has a melting viscosity of from 0.002 to 200 Pa.s at 150° C.; the softening temperature of said separation layer ranges from 50° C. to less than 200° C.; and the temperature difference between the melting point of said bonding layer and the softening temperature of said separation layer is within 50° C.

* * * * *